United States Patent [19]

McWhorter

[11] Patent Number: 5,012,534

[45] Date of Patent: May 7, 1991

[54] AUTOMATIC HAIR AND SCALP TREATMENT MACHINES

[75] Inventor: Ronnie W. McWhorter, Nashville, Tenn.

[73] Assignee: IHT, Inc., Nashville, Tenn.

[21] Appl. No.: 504,845

[22] Filed: Apr. 5, 1990

[51] Int. Cl.[5] ..... A45D 19/10

[52] U.S. Cl. ..... 4/519; 4/520; 132/212

[58] Field of Search ..... 4/515–523; 132/212, 272

[56] References Cited

U.S. PATENT DOCUMENTS

| | | | |
|---|---|---|---|
| 2,854,969 | 10/1958 | Nolan | 4/518 X |
| 3,521,647 | 1/1970 | Mercer | 4/518 X |
| 3,636,961 | 1/1972 | John et al. | 132/212 |
| 3,894,546 | 7/1975 | Nolan | 4/518 X |
| 4,771,487 | 9/1988 | Little | 4/519 |
| 4,834,121 | 5/1989 | Bell | 4/516 X |

*Primary Examiner*—Charles E. Phillips

*Attorney, Agent, or Firm*—Norman L. Wilson, Jr.

[57] ABSTRACT

An automatic hair and scalp treatment machine which includes a bowl having a front wall, and a closure therefor, adapted to enclose the head with the face outside the closure. Also included are spray manifolds on an oscillating arcuate header, and a driving device imparting partial rotation to the arcuate header. Spray heads are located on the manifolds such that spray is deflected off of the front wall onto the users neck at the hairline.

3 Claims, 2 Drawing Sheets

AUTOMATIC HAIR AND SCALP TREATMENT MACHINES

BACKGROUND OF THE INVENTION

This invention, in one of its aspects, pertains to automatic hair and scalp treatment machines. In another of its aspects the invention pertains to improvements in the apparatus characterized in earlier U.S. Pat. No. 4,834,121.

The invention which was the basis of U.S. Pat. No. 4,834,121 overcame the problems associated with U.S. Pat. No. 3,521,647, and particularly the disadvantages of scalp massaging devices, such as those described in U.S. Pat. Nos. 2,566,600, 2,854,969, 2,854,970 and 3,177,868. The invention in 3,521,647 did have some drawbacks. It was not until after a large number of hair treatments that it was found that in the earlier machine the contacting action was not quite that desired. Accordingly it was then improved by the invention in U.S. Pat. No. 4,834,121. That apparatus included a bowl, and a closure therefor, adapted to enclose the head with the face outside the closure. Also included were spray manifolds on an oscillating arcuate header, and driving means imparting partial rotation to the arcuate header. It was found that there were gaps or skips in spray in prior art devices. It was this imperfect action which was improved by the invention in U.S. Pat. No. 4,834,121. In the U.S. Pat. No. 4,834,121, means were provided for dispensing treating solutions in the form of sprays so oriented that they coacted with each other as they sprayed the head from front to back.

The apparatus of U.S. Pat. No. 4,834,121 solved most of the problems which previously surfaced. But one unsolved problem was that of contacting the neck. Hair is generally between the spray from the lower manifold, and the neckline when the lower manifold is on its way from the top of the head to the front bowl wall. If the hair is long, it clings to the bowl and neck is not contacted. If the hair is shorter it still shields the neck. If interest is in applying medicines to the neck, the machine is unsatisfactory. This inadequacy is particularly significant if a skin disease on the neck is to be treated. Even when hair is somewhat shorter spray from the lower manifold nevertheless drives it against the neck, impairing the treating action of the spray. Herein the problem of contacting the neck near the hairline has been solved.

SUMMARY OF THE INVENTION

As noted, this invention is concerned with the type of apparatus for use in applying hair and scalp treating solutions to the human head, which includes a bowl, a closure therefor adapted to enclose the head with the face outside the closure and the back of the neck on the bowl front. An arcuate header, in the form of upper and lower spray manifolds, is adapted to oscillate in an arc from a point opposite the forehead to a point opposite the neck. Means are provided for partially rotating the arcuate header to effect this oscillatory movement, as the sprays are dispensing the treating solutions. Herein, to improve the contact of sprays with the base of the head, at least one nozzle on the lower manifold is disposed at an angle of inclination which is away from the upper manifold with respect to the plane in which the lower arcuate manifold lies. This angle of inclination is so correlated with the slope of the front wall of the bowl that, during the approach of the lower manifold to its oscillation reversal point adjacent the front bowl wall, spray therefrom is deflected off of the front bowl wall onto the neck near the hairline. It drives the hair away from the bowl wall, and separates strands of hair which previously clung to the front bowl wall. The deflection of spray allows spray to contact the neck.

BRIEF DESCRIPTION OF THE DRAWINGS

For a complete understanding of the invention reference is made to the accompanying drawings.

DETAILED DESCRIPTION OF THE INVENTION

Figure 1:
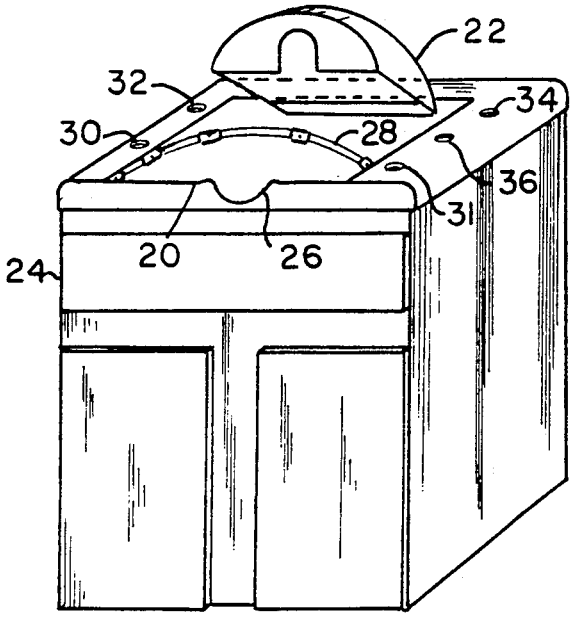
FIG. 1 is a perspective view of the machine improved by this invention.
Figure 2:
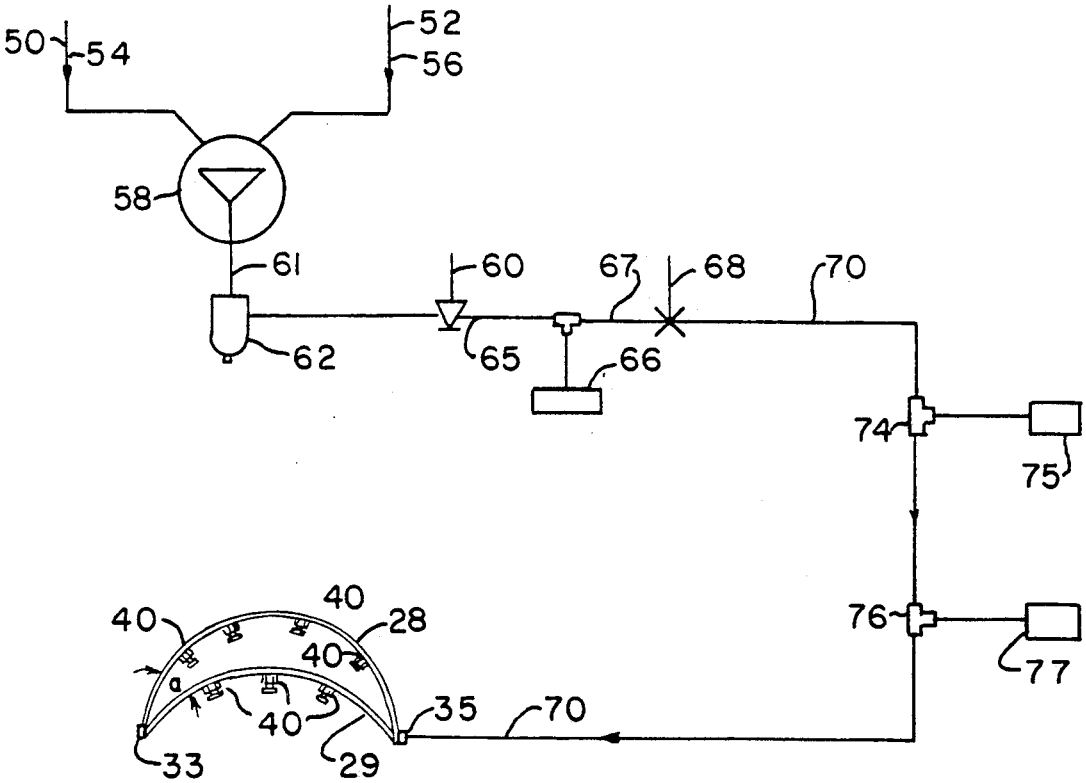
FIG. 2 is a diagrammatic representation of the spray system utilized in the improved apparatus.

Preliminarily, considering the general features of the invention, as shown in FIG. 1, the automatic hair treating apparatus includes a bowl 20 mounted in a cabinet 24 and provided with a lid or cover 22. The neck rest is shown at 26. One of the two washing elements, upper manifold 28, is visible. The other manifold, 29, is disposed at an angle thereto as shown in FIG. 2. Spray nozzles are mounted on the manifolds to dispense either fan shaped or cone shaped sprays. Control knobs 30, 31, 32, 34 and 36 are also visible in FIG. 1.

Prior to discussing the invention herein, the operation of the apparatus should be described. An examination of FIG. 2 shows that the header includes two or more manifolds joined on a common axis 33 and 35. Partial rotation or oscillation of this header unit is accomplished by reduction gears, bell crank arms, or other well known means for achieving oscillation. Hot water 50 and cold water 52 enter the hair and scalp treating apparatus through lines 54 and 56 respectively. These flow into a temperature control valve 58 which maintains a temperature of about 105 degrees. Flow into temperature control valve 58, and hence throughout the system, is controlled by a solenoid valve 60. Before passing through solenoid valve 60, incoming water in hydraulic line 61 passes through a filter 62. To increase the pressure of the incoming solutions to a pressure within a range better suited to the action of treating manifolds 28 and 29, say, 80 to 120 psi, solution line 65 conducts the solutions to pressure pump 66. The output from this pump flows through line 67 to pressure regulator 68. From the pressure regulator, the solution, now at the desired temperature and pressure, flows through line 70 to manifolds 28 and 29. These manifolds oscillate about an axis through pivot points 33 and 35 so that they progress back and forth opposite the head.

A problem which, until recently has been unsolved, has been that of contacting the neck below the hairline. By the time the lower manifold approaches the front bowl wall, the already wet hair, from solutions running down over it, is so soaked that it hangs down ahead of the approaching lower spray manifold. Hence sprays do not reach the base of the head because hair is in the way.

Figure 3:
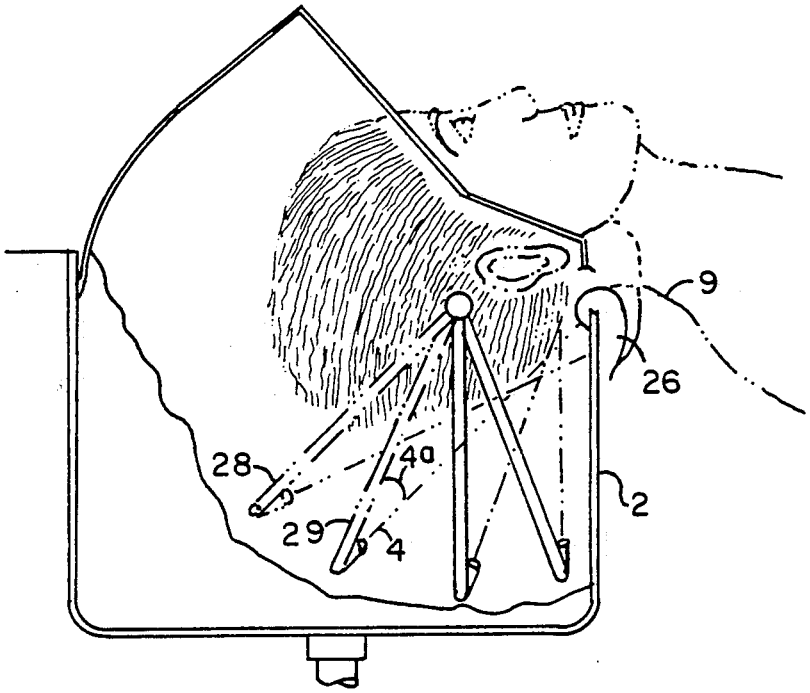
FIG. 3 is a diagrammatic representation of an improved spray manifold.
Figure 4:
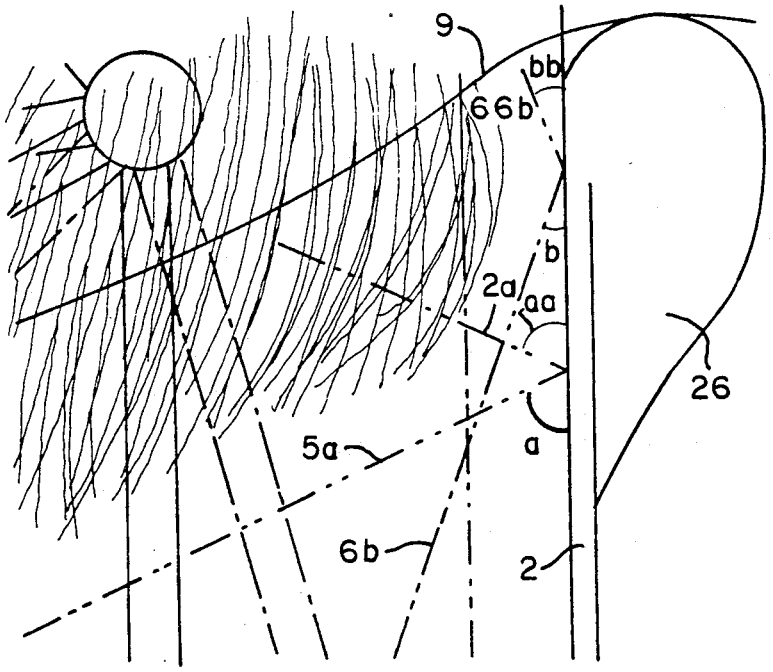
FIG. 4 is a diagrammatic view showing various spray deflection angles.

It has now been found that if at least one nozzle on the lower manifold is inclined outwardly, that is, at an angle of inclination out of the plane in which the lower manifold 29 lies, away from the upper manifold spray therefrom can be made to bounce off the front bowl wall 2 as shown in FIGS. 3 and 4.

FIG. 3, by phantom lines, shows lower header 29 in three different positions. It can be seen that, on impact with bowl wall 2, spray 4 is deflected an an angle thereto equal to the angle of impact.

FIG. 4 is a diagrammatic view showing the deflection angles. It is evident that the farther the nozzle is from the bowl wall, the larger the deflection angle will be. Thus, when spray 5*a* impinges against the front wall 2 of the bowl at an angle a, the deflection angle aa is equal to impact angle a. It is apparent that these two angles a and aa are greater than angles b and bb, generated when the spray is closer to the bowl front. An examination of spray 5*a* in FIG. 4 shows that it is deflected at an angle of deflection such that it hits hair above the hairline. But as the manifold approaches bowl wall 2, as in spray 6*b*, the impact angle b is much smaller. Since the deflection angle bb is equal to impact angle b, spray 6*bb* hits neck 9, shown in FIG. 4. It can be seen, then, that with a change in the angle of inclination of the nozzle it is possible to deflect the spray from it to almost any point on the head. Hence the angle of inclination must be so correlated with the slope of the front bowl wall that throughout the third of the arc through which the lower manifold oscillates ahead of the front of the bowl spray therefrom is deflected off of the front bowl wall to the neck near the neckline. This correlation with the slope of the bowl front is such that if the locus of the points through which the inclined nozzle passes during oscillation is four to nine inches from the head, the angle of deflection, given a vertical front bowl wall, is less than 75 degrees. By so correlating the nozzle angle, spray is deflected off of the bowl wall so that it impinges on the back of the head just above and below the hairline, driving the hair away from the front bowl wall, and separating strands of hair which previously clung to the front bowl wall. Illustrating this, angle a in FIG. 4 is 65 degrees, and, of course, angle aa will be the same. As the manifold comes closer to bowl wall 2 the impact angle decreases. In the case of spray 6*b*, for instance, the impact angle b is now 20 degrees, as is deflection angle bb.

Now if the bowl wall is not vertical, these angles decrease or increase, depending upon whether the bowl is inclined inwardly or outwardly. In the case of an outward bowl inclination the deflection angle becomes smaller, and an inward bowl wall inclination yields a larger deflection angle. As an example, angle a decreases from 65 degrees to 55 degrees if the bowl wall is inclined outwardly 10 degrees from the vertical. The angle of deflection will also be 55 degrees. If the bowl wall is inclined inwardly 10 degrees from the vertical, impact angle a will be a 75 degree angle, as will aa.

It is understood that the angle of nozzle inclination, that is, the angle between the nozzle and the plane in which the manifold lies, angle 4*a* in FIG. 3, depends upon three parameters, the radius, the location of the header axis, and the slope of the front bowl wall. In effect it depends upon the locus of the points generated by the lower manifold on its way to the front bowl wall. In other words a series of impact angles are generated depending upon the location of the nozzle in the arc of the manifold, and its distance from the front bowl wall. With the manifold a few inches from the head this angle of inclination will normally be 18 to 22 degrees, correlated with the slope of the front bowl wall. This correlation is best accomplished by reverse engineering, first measuring a deflection angle from the bowl front wall to a point on the neck. Knowing that deflection angle, the impact angle can be calculated, and from the impact angle the angle of inclination can be determined. Given these considerations this correlation is within the skill of the art.

In the light of the teachings of this invention variations and modifications will occur to those skilled in this field. Thus, for a more concentrated deflection spray, the impact spray should be a fan spray. It should be a spray in which the fan would be in the plane of the header if it were not emanating from an inclined nozzle. The number of inclined nozzles on the lower manifold is also subject to some latitude. The number of sprays will depend upon the total system pressure. Whereas one nozzle on the lower manifold, on an imaginary center line through the manifold is sufficient, two nozzles can be so correlated with the slope of the bowl wall if desired. Such modifications are deemed to be within the scope of this invention.

What is claimed is:

1. In the apparatus for use in applying hair and scalp treating solutions to the human head, which includes a bowl having a front wall, a closure therefor adapted to enclose the head with the face outside the closure and the base of the neck on top of the front bowl wall, an arcuate header including an upper and a lower spray manifold adapted to oscillate in an arc from a point where said upper manifold is located opposite the forehead to a point where said lower manifold is located adjacent the bowl front, means imparting partial rotation to the arcuate header to effect said oscillatory movement, a plurality of nozzles disposed on each manifold to dispense adjacent pressurized sprays of treating solutions against the head, means for contacting the neck area with sprays wherein at least one nozzle on the lower manifold is disposed at an angle of inclination away from the upper manifold with respect to the plane in which the lower arcuate manifold lies, wherein the angle of inclination is so correlated with the slope of the front bowl wall that throughout the third of the arc through which the lower manifold oscillates ahead of the front of the bowl spray therefrom is deflected off of the front bowl wall, impinging on the back of the head above and below the hairline, driving the hair away from the front bowl wall, and separating strands of hair which previously clung to the front bowl wall.

2. The apparatus of claim 1 wherein the angle of inclination of the inclined nozzle is correlated with the slope of the bowl front so that if the locus of the points through which the inclined nozzle passes during oscillation is four to nine inches from the head, the angle of deflection, given a vertical front bowl wall, is less than 75 degrees.

3. The apparatus of claim 2 wherein the spray dispensed by the inclined nozzle is a fan spray which would be in the plane of the manifold if the nozzle were not inclined.

* * * * *